US010014575B2

(12) United States Patent
Park et al.

(10) Patent No.: US 10,014,575 B2
(45) Date of Patent: Jul. 3, 2018

(54) ANTENNA DEVICE AND ELECTRONIC DEVICE HAVING THE ANTENNA DEVICE

(71) Applicant: Samsung Electronics Co., Ltd., Suwon-si, Gyeonggi-do (KR)

(72) Inventors: Sung-Wu Park, Daegu (KR); Soon-Sang Park, Daegu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 160 days.

(21) Appl. No.: 14/301,997

(22) Filed: Jun. 11, 2014

(65) Prior Publication Data

US 2015/0009090 A1 Jan. 8, 2015

(30) Foreign Application Priority Data

Jul. 8, 2013 (KR) ..... 10-2013-0079699

(51) Int. Cl.

| | |
|---|---|
| ***H01Q 3/24*** | (2006.01) |
| ***H01Q 1/50*** | (2006.01) |
| ***H01Q 1/24*** | (2006.01) |
| ***H01Q 1/48*** | (2006.01) |
| ***H01Q 9/42*** | (2006.01) |

(52) U.S. Cl.

CPC ..... *H01Q 1/50* (2013.01); *H01Q 1/243* (2013.01); *H01Q 1/48* (2013.01); *H01Q 9/42* (2013.01)

(58) Field of Classification Search

CPC .. H01Q 1/50; H01Q 1/48; H01Q 9/42; H01Q 1/243

See application file for complete search history.

(56) References Cited

U.S. PATENT DOCUMENTS

| | | | | |
|---|---|---|---|---|
| 4,929,196 | A * | 5/1990 | Ponn | H01R 13/7195 333/185 |
| 2006/0111162 | A1* | 5/2006 | Seol | H01Q 1/243 455/575.5 |
| 2008/0100519 | A1* | 5/2008 | Ku | H01Q 1/243 343/702 |
| 2008/0143614 | A1 | 6/2008 | Park et al. | |
| 2008/0258993 | A1* | 10/2008 | Gummalla | H01Q 1/243 343/876 |
| 2008/0316120 | A1* | 12/2008 | Hirota | H01Q 1/2258 343/702 |
| 2009/0322629 | A1 | 12/2009 | Hung et al. | |
| 2010/0060544 | A1* | 3/2010 | Penev | H01Q 1/38 343/876 |

(Continued)

FOREIGN PATENT DOCUMENTS

| | | | |
|---|---|---|---|
| EP | 2 518 822 | A1 | 10/2012 |
| EP | 2 581 982 | A1 | 4/2013 |
| KR | 10-2011-0037223 | A | 4/2011 |

*Primary Examiner* — Trinh Dinh

(74) *Attorney, Agent, or Firm* — Jefferson IP Law, LLP

(57) ABSTRACT

An electronic device is provided. The electronic device includes an antenna radiator configured to operate in at least one frequency band, a ground stub disposed at a coupling location in proximity to the antenna radiator, and a switching device configured to selectively ground the ground stub and a ground of a main board. Thus, the present disclosure is easily applicable without design constraints in terms of space use when the main board and the antenna radiator are separated, and simplifies the assembly and reduces the cost without a separate sub-board.

11 Claims, 10 Drawing Sheets

(56) References Cited

U.S. PATENT DOCUMENTS

| | | | | |
|---|---|---|---|---|
| 2010/0214189 | A1 | 8/2010 | Kanazawa | |
| 2012/0256804 | A1* | 10/2012 | Ban | H01Q 1/48 343/848 |
| 2012/0274538 | A1 | 11/2012 | Tsou et al. | |
| 2013/0241795 | A1* | 9/2013 | Sung | H01Q 1/50 343/861 |
| 2014/0375510 | A1* | 12/2014 | Lee | H01Q 1/243 343/702 |
| 2017/0055946 | A1* | 3/2017 | Fujii | A61B 8/4461 |

* cited by examiner

ANTENNA DEVICE AND ELECTRONIC DEVICE HAVING THE ANTENNA DEVICE

CROSS-REFERENCE TO RELATED APPLICATION(S)

This application claims the benefit under 35 U.S.C. § 119(a) of a Korean patent application filed on Jul. 8, 2013 in the Korean Intellectual Property Office and assigned Serial number 10-2013-0079699, the entire disclosure of which is hereby incorporated by reference.

TECHNICAL FIELD

The present disclosure relates to an antenna device. More particularly, the present disclosure relates to an electronic device including an antenna device.

BACKGROUND

Currently, portable electronic devices for communication are developed to serve various functions in response to users' wants. For example, in addition to the basic communication function with another party, the user may listen to a variety of music using MP3 data, surf the web using a wireless Internet network, download various programs, and play and view a high-quality video at a rapid rate.

Also, the portable electronic device includes at least one high-resolution imaging device (camera lens assembly) for photographing an object. In particular, the portable electronic device may generally capture not only a still picture but also a moving pictures and a stereoscopic image.

Meanwhile, in terms of the communication function, diverse patterns operating in different frequency bands are used with the single antenna radiator. For example, the single antenna radiator may commonly use various bands such as Code Division Multiple Access (CDMA), PCS, DCS, and Global System for Mobile communications (GSM). The single antenna radiator may also use the communication function such as Wireless Fidelity (WiFi), Global Positioning System (GPS), and Bluetooth.

Often, it is infeasible to mount the individual radiator of various bands inside the electronic device is reduced in size.

Accordingly, an antenna device for achieving sufficient radiation performance even when an enough mounting space is not allowed, and an electronic device having the same is desired.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device and an electronic device having the same.

Another aspect of the present disclosure is to provide an antenna device for achieving sufficient radiation performance even when an enough mounting space is not allowed, and an electronic device having the same.

Yet another aspect of the present disclosure is to provide an antenna device for achieving sufficient radiation performance without relative design constraints, and an electronic device having the same.

Still another aspect of the present disclosure is to provide an antenna device for mounting a switchable ground without an additional sub-board even when it is separated from an antenna radiator and a main board, and an electronic device having the same.

A further aspect of the present disclosure is to provide an antenna device for reducing an assembly process and a manufacturing cost by realizing a switchable ground while excluding a sub-board and an electric connection means for electrically connecting the sub-board even when an antenna radiator is separated from a main board, and an electronic device having the same.

In accordance with an aspect of the present disclosure, an electronic device is provided. The electronic device includes an antenna radiator configured to operate in at least one frequency band, a ground stub disposed at a coupling location in proximity to the antenna radiator, and a switching device configured to selectively ground the ground stub and a ground of a main board.

In accordance with another aspect of the present disclosure, an antenna device is provided. The antenna device includes an antenna radiator configured to operate in at least one frequency band, a ground stub disposed at a coupling location in proximity to the antenna radiator, and a switching device configured to selectively ground the ground stub and a ground of a main board.

In accordance with yet another aspect of the present disclosure, an electronic device is provided. The electronic device includes a main board, an antenna carrier of a certain height one of installed to the main board and installed to avoid the main board, an antenna radiator disposed on the antenna carrier, configured to feed power to the main board, and operate in at least one frequency band, a ground stub disposed at a coupling location in proximity to the antenna radiator, and a switching device configured to selectively ground the ground stub and a ground of a main board.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
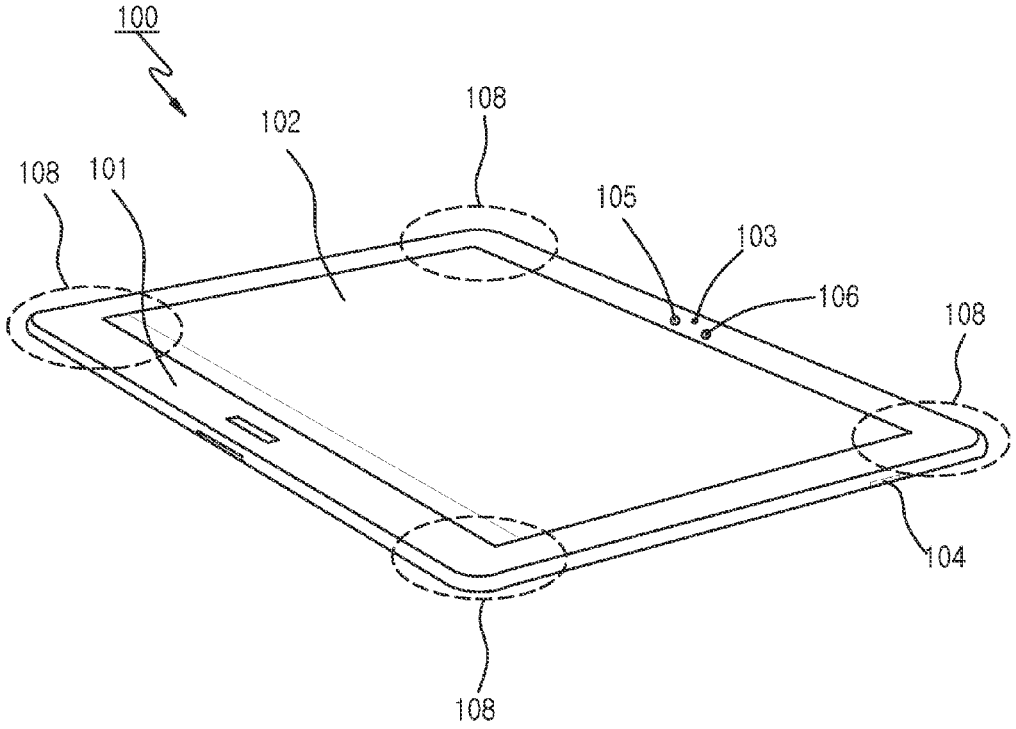
FIG. 1 is a perspective view of an electronic device including an antenna device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

According to an embodiment of the present disclosure, an electronic device may include an antenna radiator for operating in at least one frequency band, a ground stub disposed at a coupling location near the antenna radiator, and a switching device for selectively grounding the ground stub and a ground of a main board.

The ground stub may be disposed to at least partially overlap the antenna radiator. The ground stub may be disposed in parallel not to overlap the antenna radiator.

The ground stub may be disposed on an antenna carrier of the antenna radiator.

The ground stub may be secured to the main board using a connection means. The connection means may include at least one of a soldering, a C-clip, and a conductive tape.

The ground stub may be formed as a conductive pattern in a non-ground area of the main board. The ground stub may be formed in a side of the main board facing the antenna device. The ground stub may be formed in the same side of the main board as the antenna device.

The ground stub may be mounted in a case frame of the electronic device. The ground stub may be attached to an inner side of the case frame of the electronic device. The ground stub may be insert-molded to the case frame of the electronic device. The ground stub may be insert-molded to be exposed in an inner side or an outer side of the case frame. The case frame may be a battery cover.

The ground stub may include at least one of a metal plate placed inside the electronic device to a certain width, a flexible printed circuit board comprising a metal pattern, and a conductive tape.

The electronic device may include any one of a tablet Personal Computer (PC) and a mobile communication terminal.

According to an embodiment of the present disclosure, an antenna device may include an antenna radiator for operating in at least one frequency band, a ground stub disposed at a coupling location near the antenna radiator, and a switching device for selectively grounding the ground stub and a ground of a main board.

According to an embodiment of the present disclosure, an electronic device may include a main board, an antenna carrier of a certain height is installed on the main board or installed as to avoid the main board, an antenna radiator disposed on the antenna carrier, feeding power to the main board, and operating in at least one frequency band, a ground stub disposed at a coupling location near the antenna radiator, and a switching device for selectively grounding the ground stub and a ground of a main board.

An electronic device is applicable to various devices having a communication function.

While a tablet-type electronic device including a touch screen as its display is illustrated here, the present disclosure is not limited to such an electronic device. For example, the electronic device may employ various devices including an antenna device for the communication, that is, Personal Digital Assistant (PDA), laptop computer, mobile phone, smart phone, netbook, Mobile Internet Device (MID), Ultra Mobile Personal Computer (UMPC), tablet PC, and navigation.

FIG. 1 is a perspective view of an electronic device including an antenna device according to an embodiment of the present disclosure.

Referring to FIG. 1, the electronic device 100 may include a display module 102 on the electronic device's front and a bezel 101 forming an outer periphery of the electronic device 100. The display module 102 may employ a touch screen including a touch panel and a Liquid Crystal Display (LCD) module for concurrent input and output.

At least one microphone 103 may be installed above the display module 102, and at least one speaker 104 may be installed in a side of the electronic device 100. Notably, the microphone 103 and the speaker 104 may be installed at other locations of the electronic device 100.

The electronic device 100 may include a camera module 105 on the electronic device's front, and at least one sensor module 106 as a detection unit for controlling the electronic device 100 according to ambient conditions. The sensor module 106 may employ various sensors such as light sensor for controlling brightness of the display module 102 by detecting the ambient light, and proximity sensor for activating the display module 102 by detecting that the electronic device 100 is in proximity to a user's face.

The electronic device 100 may perform a communication function. For example, the electronic device 100 may perform short-range communication using a short-range communication module such as Bluetooth module or Wi-Fi module in addition to the basic communication function. The electronic device 100 may include a Global Positioning System (GPS) module for providing a location-based service using a GPS system.

Figure 2:
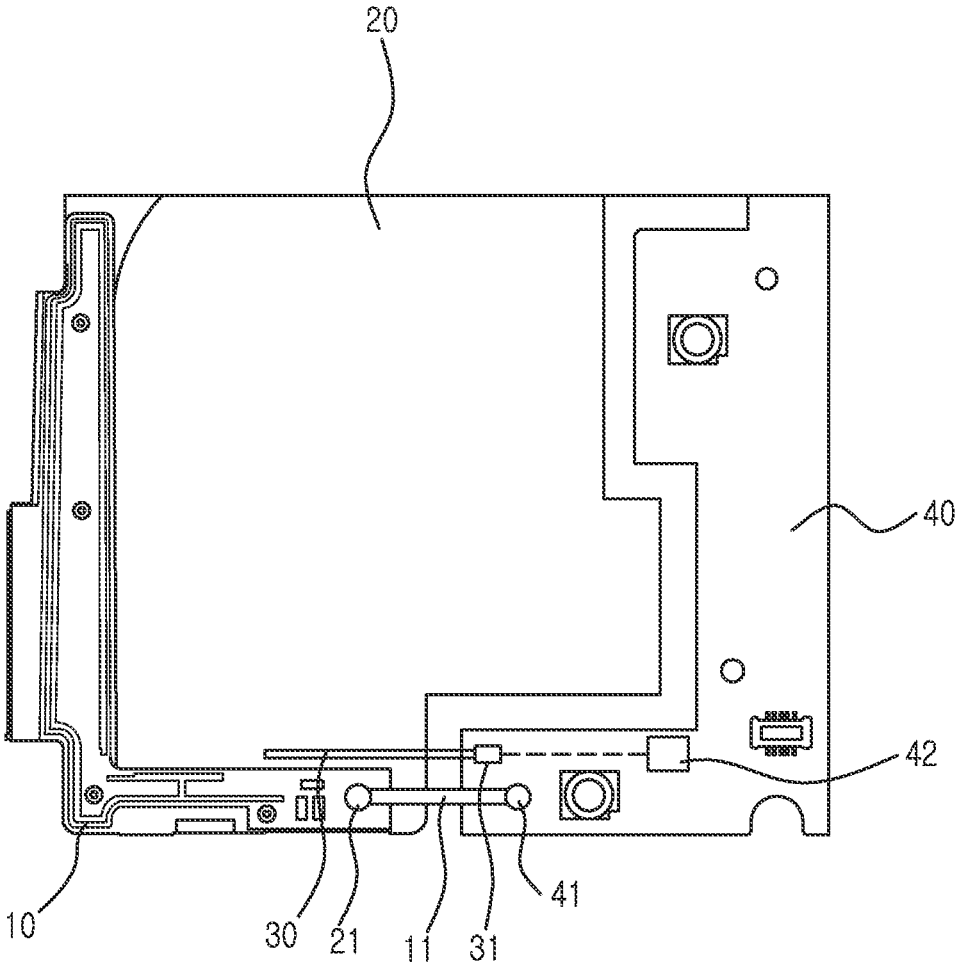
FIG. 2 is a view of an antenna device and a ground stub mounted on an electronic device according to an embodiment of the present disclosure.

The communication module may requisitely include an antenna device 10 of FIG. 2 and a conductive ground stub disposed around the antenna device for changing a use frequency band of the antenna device by inducing selective coupling with the antenna device. The antenna device may be implemented using a conductive radiator and operate in the frequency band corresponding to the module. The antenna device may also include an antenna pattern operating in the multiple bands together with the single conductive radiator. Such an antenna radiator may be referred to as a multi-band antenna radiator, and may operate in a desired frequency band generally by switching in a similar band or matching the frequency using a matching circuit.

A mounting space in the electronic device may be allowed to the antennal device and placed at a location of relatively little constraints. The antenna device may be disposed in, but not limited to, dotted regions 108 of the electronic device 100 of FIG. 1. The antenna device may be installed at various locations of the electronic device 100 in various fashions.

Figure 3:
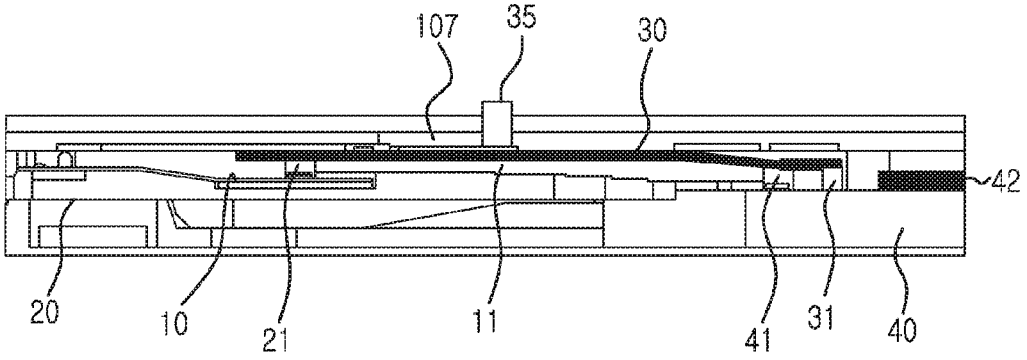
FIG. 3 is a cross-sectional view of the electronic device including the antenna device and the ground stub of FIG. 2 according to an embodiment of the present disclosure.

FIG. 2 is a view of the antenna device and the ground stub mounted in the electronic device according to an embodiment of the present disclosure, and FIG. 3 is a cross-sectional view of the electronic device including the antenna device and the ground stub of FIG. 2 according to an embodiment of the present disclosure.

Referring to FIGS. 2 and 3, a main board 40 is mounted inside the electronic device 100. The main board 40 may employ a hard PCB or a Flexible PCB (FPCB). A plurality of electronic function groups (not shown) may be mounted on the main board, and a shield may (not shown) for shielding electromagnetic waves may be deposed on the electronic function group. The antenna device 10 separated from the main board 40 by a certain distance is disposed in the side of the main board 40. The antenna device 10 may be a metallic antenna radiator including a certain pattern. The antenna device 10 may be disposed alone in the electronic device 100. The antenna device 10 may be disposed inside the electronic device 100, and attached on a dielectric antenna carrier 20 of a certain height and a certain area.

Since the antenna device 10 is distant from the main board 40, an RF coaxial cable 11 may electrically connect a feeding point 21 of the antenna device with an RF contact 41 of the main board 40. A FPCB may replace the RF coaxial cable 11 for the connection.

A connection unit 31 may electrically connect the ground stub 30 to the main board 40 with one end. The ground stub 30 is metallic in a certain length, and the other end may be disposed to be coupled with the antenna device 10 while not contacting the antenna device 10. The ground stub 30 may be electrically connected to the ground of the main board 40. A switching device 42 may be interposed between the ground stub 30 and the ground and the switching device's selective switching operation may selectively electrically connect the ground of the main board 40. The switching device 42 may be a Surface Mounted Device (SMD) on the main board 40. Ground stub 30 may be formed of a metal plate and insert-molded in the case frame 107 of the electronic device. The case frame 107 may be a synthetic resin material, and the ground stub 30 may be molded to fit the inner side or the outer side of the case frame 107, or a ground stub 35 may be inserted into the case frame 107 so as to be exposed to the outer side of the case frame or secured using the insert-molding, and concurrently improve the exterior of the electronic device as a metal decoration.

When the ground stub 30 is fixed to the main board 40 as a separate adjunct, it may be secured using at least one of soldering, C-clip, and conductive tape. The ground stub 30, which is the conductive material, may employ a metal plate formed of one of SUS, steel, aluminum, and copper, and the FPCB including the metal pattern.

The ground stub 30 may be separated from the overlapped location of the antenna device 10. The ground stub 30 does not overlap the antenna device 10 but may be placed near the coupling location.

The metallic ground stub 30 may be disposed away from the antenna radiator. Yet, it is advantageous that the ground stub should not contact the antenna radiator. It is even more advantageous that the ground stub is separated so as to selectively couple with the antenna radiator according to the switching. The ground stub may be electrically connected to a ground of a main board, and include a switching unit for selectively coupling with the antenna radiator. The switching unit may be mounted on the main board.

Although the antenna device is separated from the main board, a separate sub-board (piggyback Printed Circuit Board (PCB)) for adding the ground stub is not required. The conductive ground stub may be drawn from the main board toward the antenna radiator up to the coupling location of the antenna radiator.

Hence, the present ground stub may simplify assembly and lessen the design constraints in the design of the antenna device, compared to a conventional antenna device integrally formed with the antenna radiator separated from the main board or realizing the switchable ground based on the direction contact.

Figure 4A:
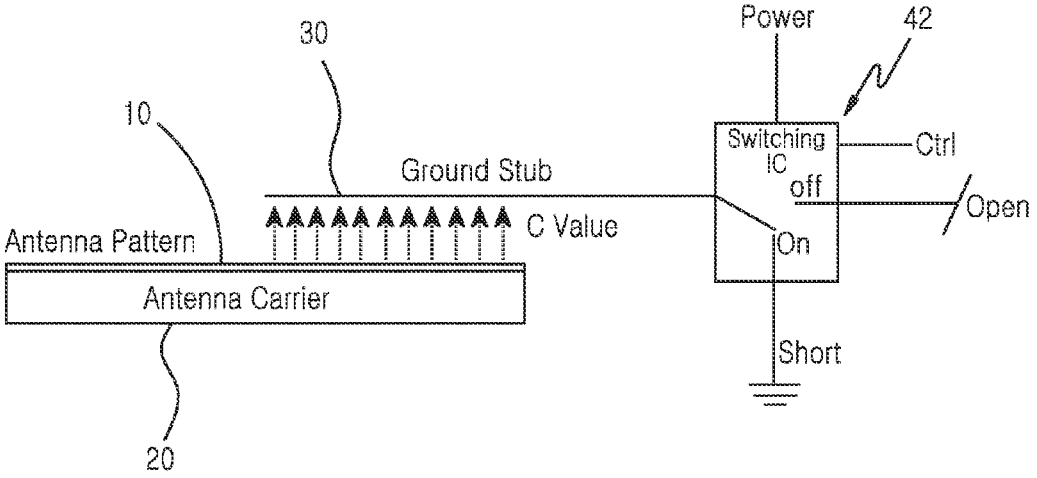
FIGS. 4A and 4B are diagrams of various switching modes of a ground stub according to an embodiment of the present disclosure.
Figure 4B:
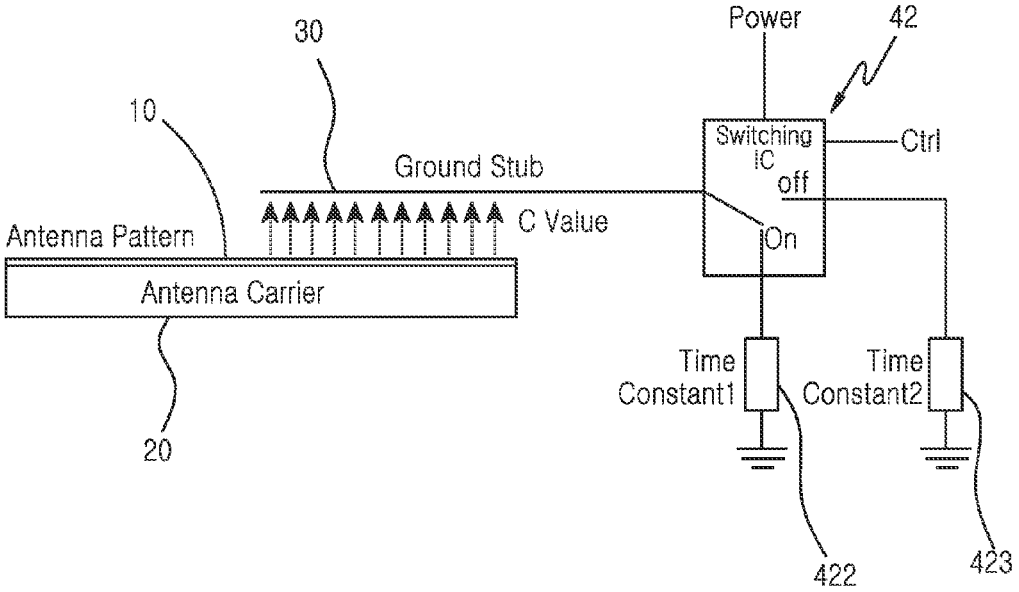

FIGS. 4A and 4B depict various switching modes of the ground stub according to an embodiment of the present disclosure.

Referring to FIG. 4A, the ground stub 30 overlaps the antenna device 10 secured on the antenna carrier 20, and one end of the ground stub 30 is electrically connected to the ground of the main board via the switching device 42. Hence, the switching device 42 may be selectively grounded to the main board. When being grounded to the main board, the ground stub 30 may change the use frequency band according to the coupling with the antenna device 10.

Referring to FIG. 4B, the ground stub 30 overlaps the antenna device 10 secured on the antenna carrier 20, and one end of the ground stub 30 is electrically connected to the ground of the main board via the switching device 42. While the switching device 42 is connected to the ground, the switching device's connection paths have a first time constant 422 and a second time constant 423 which are different from each other to thus achieve different impedance matching of the antenna device. The first time constant 422 and the second time constant 423 may include at least one of at least one inductance and at least one capacitance as the matching circuit.

Figure 5A:
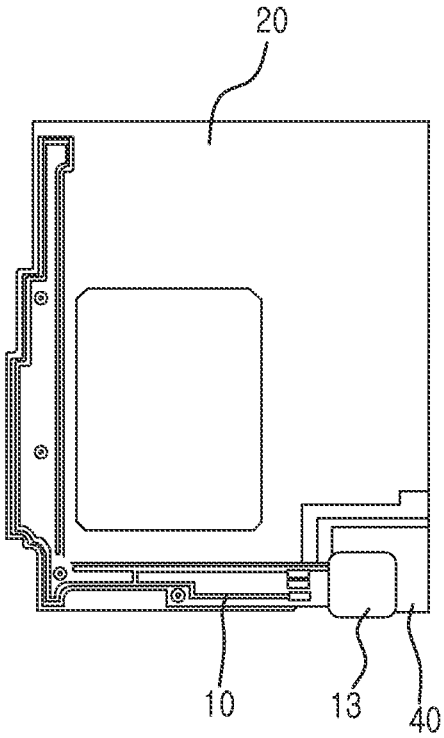
FIGS. 5A and 5B are diagrams of a ground stub mounted on a main board according to an embodiment of the present disclosure.
Figure 5B:
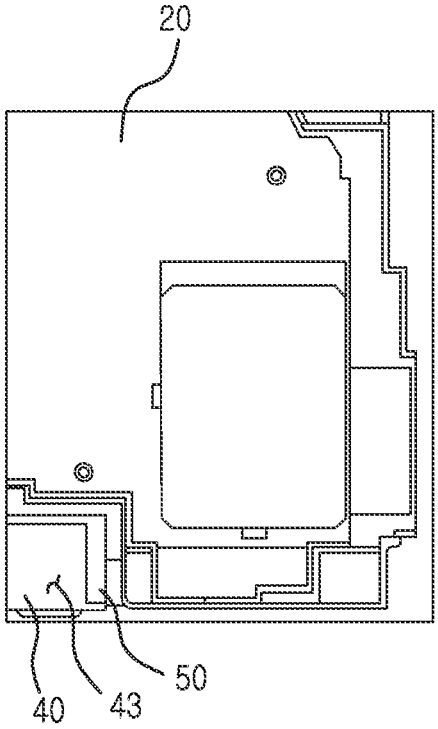

FIGS. 5A and 5B depict the ground stub mounted on the main board according to an embodiment of the present disclosure.

Referring to FIGS. 5A and 5B, a ground stub 50 may be patterned on the main board 40, rather than the separate adjunct. The ground stub 50 may be formed in a non-ground area 43 of the main board 40. In this case, as the main board 40 is placed relatively near the antenna carrier 20, an RF connector 13 of the antenna device 10 and the main board 40 may be electrically connected directly.

The ground stub 50 placed in the non-ground area 43 of the main board 40 may be formed in the same surface of the main board 40 as the antenna radiator 10 or in the opposite surface of the main board 40 from the antenna radiator 10 when the coupling is feasible. Although it is not depicted, the ground stub 50 patterned on the main board 40 may be electrically connected to the ground of the main board 40 via the switching device.

Figure 6A:
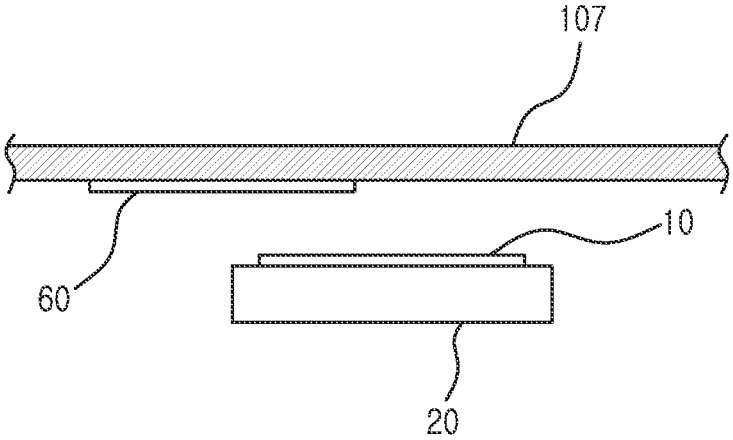
FIGS. 6A and 6B are cross-sectional views of a ground stub mounted in a case frame of an electronic device according to an embodiment of the present disclosure.
Figure 6B:
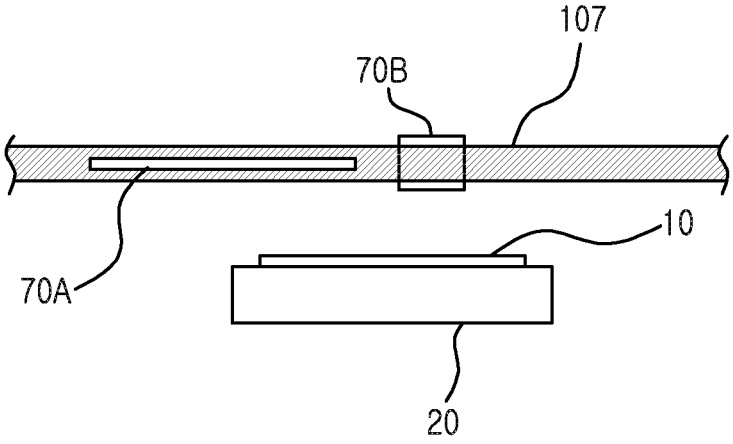

FIGS. 6A and 6B are cross-sectional views of the ground stub placed in a case frame of an electronic device according to an embodiment of the present disclosure.

Referring to FIG. 6A, a ground stub 60, being a plate type, may be attached to an inner side of a case frame 107 of the electronic device. The ground stub 60 may be placed for the coupling to overlap or not to overlap the antenna radiator 10. The ground stub 60 may be a metal plate, a FPCB including the metal pattern, a metal tape, and a metal spray layer spread inside the case frame 107 to a certain area and a certain thickness. Although it is not depicted, the ground stub 60 may be electrically connected to the ground of the main board via the switching device.

Referring to FIG. 6B, a ground stub 70A may be formed of a metal plate and insert-molded in the case frame 107 of the electronic device. The case frame 107 may be a synthetic resin material, and the ground stub 70A may be molded to fit the inner side or the outer side of the case frame 107 or, a ground stub 70B may be inserted into the case frame 107 so as to be exposed to the outer side of the case frame or secured using the insert-molding, and concurrently improve the exterior of the electronic device as a metal decoration.

Although it is not depicted, the ground stub may be electrically connected to the ground of the main board 40 via the switching device.

The case frame may be, but not limited to, a front case frame or a rear case frame of the exterior of the electronic device. The case frame may be a battery cover of the electronic device.

Besides the main board, the case frame, and the battery cover, the ground stub may be placed on the antenna carrier to be separated from the antenna device.

Figure 7:
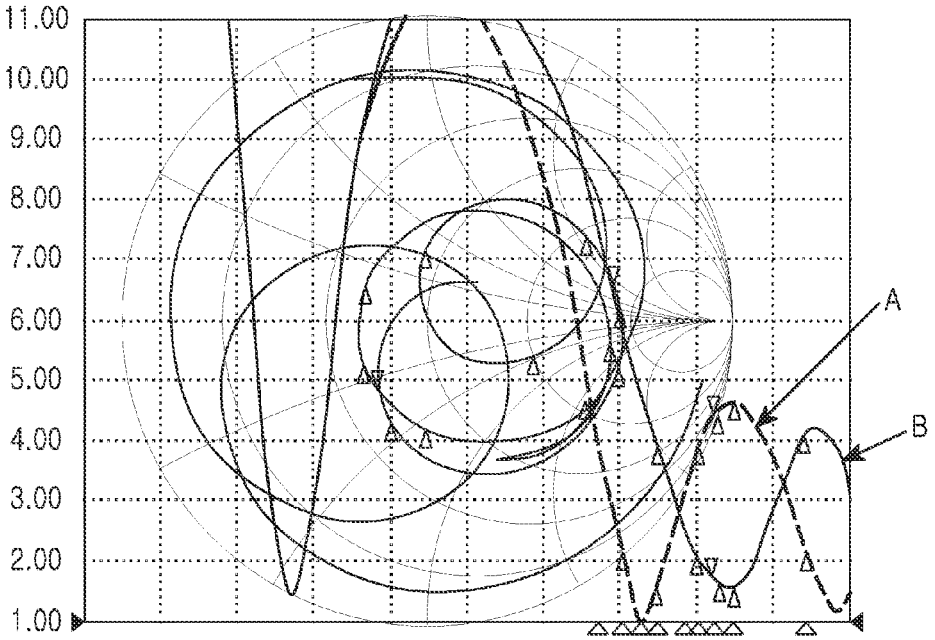
FIG. 7 is a graph of a standing wave ratio and Smith chart of an antenna device according to a ground stub according to an embodiment of the present disclosure.

FIG. 7 is a graph of a standing wave ratio and Smith chart of the antenna device according to the ground stub according to an embodiment of the present disclosure.

Referring to FIG. 7, the antenna device operates in different frequency bands when the ground stub is connected to the ground as indicated by A and when the ground is not connected to the ground as indicated by B. That is, the switching of the switching device selectively interconnects the ground stub and the ground and accordingly the use frequency band shifts.

As set forth above, the present disclosure is easily applicable without the design constraints in terms of the space use when the main board and the antenna radiator are separated, and simplifies the assembly and reduces the cost without the separate sub-board.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a main board;

a case frame;

an antenna carrier;

an antenna radiator disposed on the antenna carrier, the antenna radiator configured to operate in at least one frequency band;

a ground stub configured to change a frequency band received by the electronic device by selective coupling of the ground stub with the antenna radiator, the ground stub being electrically coupled to, and spaced apart from, the antenna radiator; and a switching device configured to electrically connect the ground stub to a ground of the main board, wherein the ground stub is insert-molded into the case frame of the electronic device so as to be exposed to an outer side of the case frame.

2. The electronic device of claim 1, wherein the ground stub is disposed to at least partially overlap the antenna radiator.

3. The electronic device of claim 1, wherein the ground stub is disposed in parallel with the antenna radiator and not to overlap the antenna radiator.

4. The electronic device of claim 1, wherein the ground stub is mounted in the case frame of the electronic device.

5. The electronic device of claim 4, wherein the ground stub is attached to an inner side of the case frame of the electronic device.

6. The electronic device of claim 1, wherein the ground stub is insert-molded and exposed in an inner side of the case frame.

7. The electronic device of claim 4, wherein the case frame is a battery cover.

8. The electronic device of claim 1, wherein the ground stub comprises at least one of a metal plate disposed within the electronic device, a flexible printed circuit board comprising a metal pattern, or a conductive tape.

9. An antenna device comprising:

a main board;

a case frame;

an antenna radiator configured to operate in at least one frequency band;

a ground stub selectively coupled to, and spaced apart from, the antenna radiator; and a switching device configured to electrically connect the ground stub to a ground of a plurality of grounds of the main board, wherein the ground stub is insert-molded into the case frame of the electronic device so as to be exposed to an outer side of the case frame.

10. An electronic device comprising:

a main board;

a case frame;

an antenna carrier;

an antenna radiator disposed on the antenna carrier, configured to feed power to the main board, and operate in at least one frequency band;

a ground stub selectively coupled to, and spaced apart from, the antenna radiator; and a switching device configured to electrically connect the ground stub to a ground of the main board, wherein the ground stub is insert-molded into the case frame of the electronic device so as to be exposed to an outer side of the case frame.

11. The electronic device of claim 10, wherein the ground stub is mounted in the case frame of the electronic device.

* * * * *